United States Patent [19]

Masui et al.

[11] Patent Number: 4,970,873

[45] Date of Patent: Nov. 20, 1990

[54] ENGINE STARTING DEVICE FOR MULTIPLE ENGINE-DRIVEN AIR CONDITIONER

[75] Inventors: Takeshi Masui, Kariya; Yuzuru Uehara, Chiryu, both of Japan

[73] Assignee: Aisin Seiki Kabushiki Kaisha, Kariya, Japan

[21] Appl. No.: 410,427

[22] Filed: Sep. 21, 1989

[30] Foreign Application Priority Data

Sep. 30, 1988 [JP] Japan ..... 63-244572

[51] Int. Cl.[5] ..... F25B 27/00

[52] U.S. Cl. ..... 62/228.4; 62/323.1; 123/360; 123/DIG. 8

[58] Field of Search ..... 62/323.1, 323.3, 323.4, 62/228.1, 228.3, 228.4, 228.5, 230, 226, 227, 510; 236/1 EA; 123/336, 360, DIG. 8

[56] References Cited

U.S. PATENT DOCUMENTS

| | | | |
|---|---|---|---|
| 3,529,434 | 9/1970 | Hough, Jr. | 62/230 |
| 4,531,379 | 7/1985 | Diefenthaler, Jr. | 123/DIG. 8 |
| 4,790,403 | 12/1988 | Akita et al. | 123/360 X |
| 4,825,663 | 5/1989 | Nijjar et al. | 62/510 X |

*Primary Examiner*—Harry B. Tanner

*Attorney, Agent, or Firm*—Banner, Birch, McKie & Beckett

[57] ABSTRACT

The invention relates to a speed control system for a multiple engine air conditioning system in which two or more engines are used to drive respective compressors for operation of two or more heat pump circuits. According to the invention, the engine speed control system has a negative pressure generating circuit connected in common to the intake manifolds of two or more engines.

1 Claim, 3 Drawing Sheets

ENGINE STARTING DEVICE FOR MULTIPLE ENGINE-DRIVEN AIR CONDITIONER

FIELD OF THE INVENTION

This invention relates to a speed control system for an engine-driven air conditioner.

DESCRIPTION OF THE PRIOR ART

In recent years, interest has grown in the use of multiple engine-driven air-conditioning systems in which two or more engines are used to drive respective compressors for operation of two or more heat pump circuits.

In this kind of arrangement, engine speed control calls for a speed control system such as proposed in Japanese Unexamined Patent Publication No. 62-233433. However, when each such engine is provided with a speed controller independent of the others, the number of system components increases, making the overall system very complex, space-consuming, and very expensive. This will easily be understood in view of the fact that the negative pressure generating circuit alone in the speed controller has such bulky components as a vacuum pump.

OBJECTS OF THE INVENTION

An object of this invention is to eliminate the above-mentioned drawbacks of the conventional system and to realize a compact, inexpensive engine-driven air conditioner speed controller by minimizing the number of components required.

SUMMARY OF THE INVENTION

To achieve these and other objects of the invention, the engine speed control system according to this invention has a negative pressure generating circuit common to the intake manifolds of two or more engines. Preferably, the engine-driven air conditioner engine speed control system comprises a plurality of engines, each having a heat pump circuit including a compressor, a refrigerator circuit reversing valve, an indoor heat exchanger, expansion valves and an outdoor heat exchanger; a negative pressure generating circuit commonly connected to the intake manifolds of a plurality of engines; a plurality of negative pressure transmission circuits connected to the negative pressure generating circuit via a multi-port joint; actuators in the negative pressure transmission circuits for controlling the throttle levers of each engine; and a controller for controlling the negative pressure generating circuit and the negative pressure transmission circuits.

The speed of each engine is sensed by the operation of its ignition coil and this information is sent to the controller.

When the compressor clutch is turned on or off according to changes in air conditioning requirements, the engine load changes to vary the engine speed. The controller senses the engine speed change and controls the negative pressure generating circuit common to the engines and the negative pressure transmission circuits for the respective engines.

More specifically, based on the engine speed detected by the controller, a negative pressure necessary to compensate for the speed change is generated in the common negative pressure generating circuit, and is supplied to the negative pressure transmission circuit leading to a specific engine whose speed is to be compensated.

By the negative pressure fed to the negative pressure transmission circuit, the actuator is driven to turn the throttle valve of the engine to regulate the fuel feed, thereby recouping a standard speed under specific operating conditions.

In case all the engines are at rest, the speed control gets started only after the vacuum pump in the negative pressure generating circuit is turned on. But when at least one engine is in operation, the vacuum pump in the negative pressure generating circuit is always held on. Accordingly, the speed controller responds quickly to engine load changes.

DETAILED DESCRIPTION OF THE PREFERRED EMBODIMENT

The invention will be better understood from the following description given in connection with the accompanying embodiment of this invention.

Figure 1:
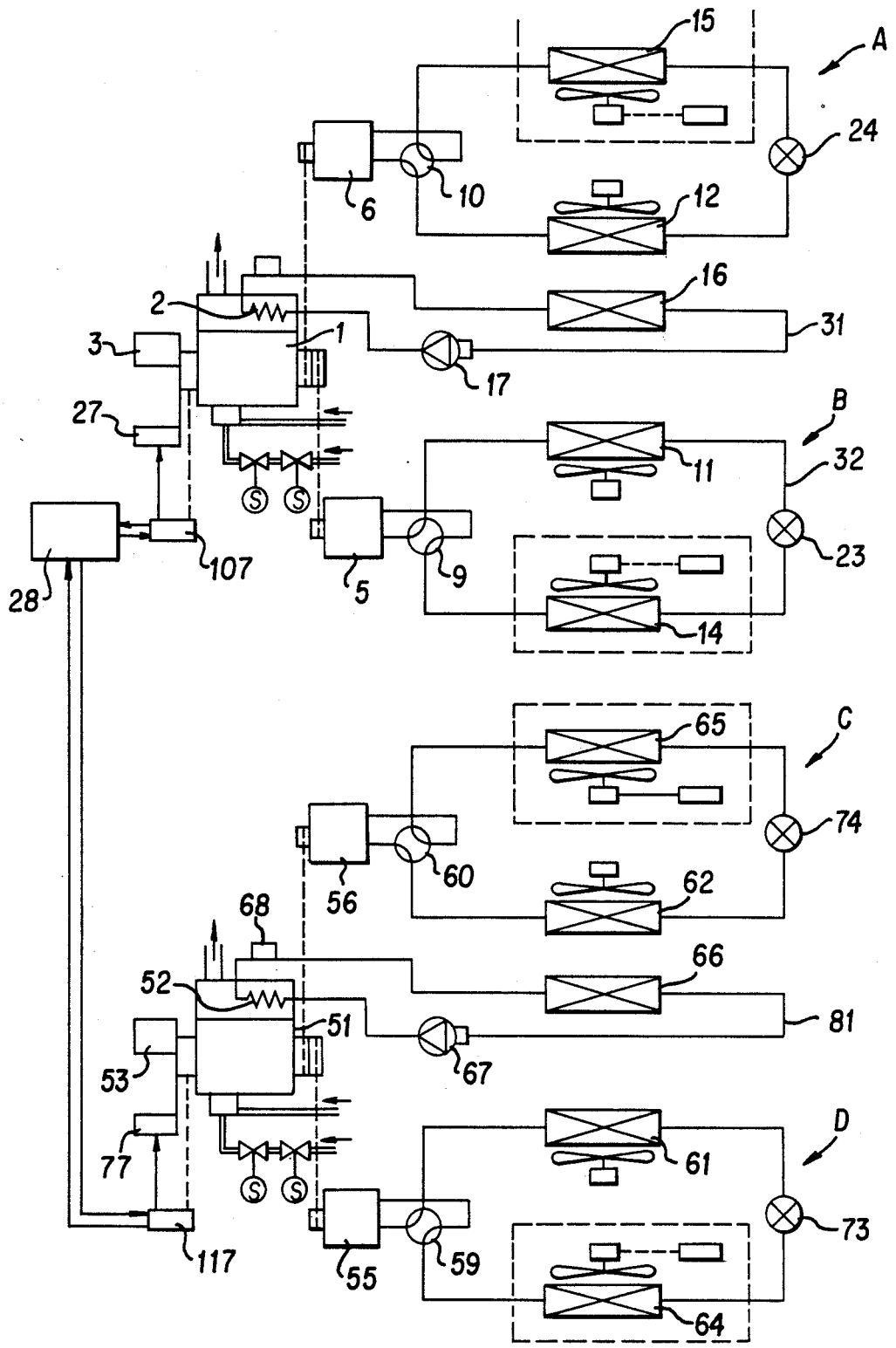
FIG. 1 is the overall arrangement of the preferred embodiment of the invention.
Figure 2:
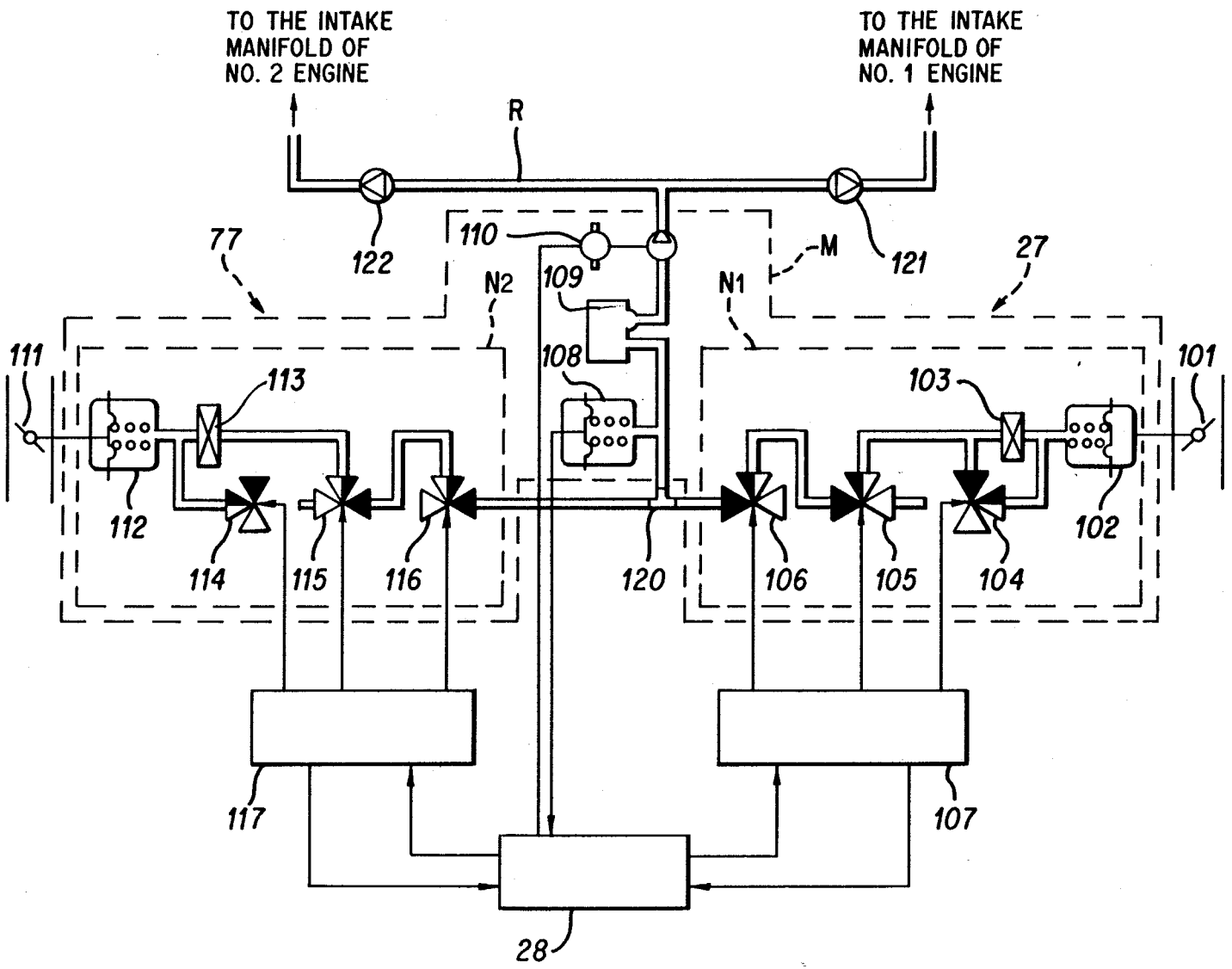
FIG. 2 illustrates the configuration of several components employed in the preferred embodiment of the invention.

Referring now to FIGS. 1 and 2, No. 1 engine (1) drives both No. 1 compressor (5) and No. 2 compressor (6) via a belt to serve two heat pump circuits A and B. Similarly, No. 2 engine (51) drives both No. 3 compressor (55) and No. 4 compressor (56) via a belt to serve two heat pump circuits C and D.

No. 1 engine (1) and No. 2 engine (51) are provided with starters (3) and (53), respectively. These starters (3) and (53) are connected respectively to actuators (27) and (77). Actuator (27) is connected to speed controller (107), and actuator (77) to speed controller (117).

As illustrated in FIG. 2, actuators (27) and (77) hold a negative pressure generating circuit (M) in common with respective negative pressure transmission circuits ($N_1$) and ($N_2$). The controller (28) controls the negative pressure generating circuit, and the speed controllers (107) and (117) control respective negative pressure transmission circuits ($N_1$) and ($N_2$).

As shown in FIG. 1, No. 1 engine (1) has an engine cooling water system (31) consisting of an exhaust gas heat exchanger (2), engine cooling water temperture detector (18), radiator (16) and a water pump (17). Similarly No. 2 engine (51) comprises an engine cooling water system (81) consisting of an exhaust gas heat exchanger (52), engine cooling water temperature detector (68), radiator (66) and a water pump (67).

The heat pump circuit (A) comprises compressor (6), reversing valve (10), indoor het exchanger (15), expansion valve (24) and outdoor heat exchanger (12). Heat pump circuit (B) comprises compressor (5), reversing valve (9), indoor heat exchanger (11), expansion valve (23) and outdoor heat exchanger (14).

Similarly, the heat pump circuit (C) comprises compressor (56), reversing valve (60), indoor heat exchanger (65), expansion valve (74) and outdoor heat exchanger (62), while heat pump circuit (D) comprises compressor (55), reversing valve (59), indoor heat exchanger (61), expansion valve (73), and outdoor heat exchanger (64).

As illustrated in FIG. 2, the pipeline (R) which terminates at the intake manifolds of No. 1 engine (1) and No. 2 engine (51) has its center connected to the common negative pressure generating circuit (M).

There are provided check valves (121) and (122) between the center and the ends of the pipeline (R). When the pressure in the intake manifold of No. 1 engine (1) or No. 2 engine (51) is lower than the pressure in the negative pressure generating circuit (M), air is supplied from the negative pressure generating circuit (M) to the intake manifold of No. 1 engine (1) or No. 2 engine (51).

In this way, it is possible to determine a negative pressure at the intake manifold of each engine independent of the other for various purposes, such as specifying the ignition timing, for example.

The negative pressure generating circuit (M) comprises vacuum pump (110), vacuum tank (109), and vacuum switch (108). The output end of the negative pressure generating circuit is connected to a multiple port joint (120).

A signal circuit is provided between the controller (28) and the vacuum pump (110) and another between the controller (28) and vacuum switch (108). One outlet of the multiple port joint (120) is connected with No. 1 negative pressure transmission circuit consisting of a control valve (106), vent valve (105), gain control valve (104), orifice (103) and actuator (102). The actuator (102) is linked to the throttle lever (101) of No. 1 engine (1).

The speed controller (107), control valve (106), vent valve (105), and the gain control valve (104) are connected together with a signal circuit, and the speed controller (107) and the controller (28) are also connected together with a signal circuit.

The other end of the multiple port joint (120) is connected with No. 2 negative pressure transmission circuit consisting of a control valve (116), vent valve (115), gain control valve (114), orifice (113) and actuator (112). The actuator (112) is linked to the throttle lever (111) of No. 2 engine (51). The speed controller (117), control valve (116), vent valve (115), and the gain control valve (114) are connected together with a signal circuit, and the speed controller (117) and the controller (28) are also connected together with a signal circuit.

Figure 3:
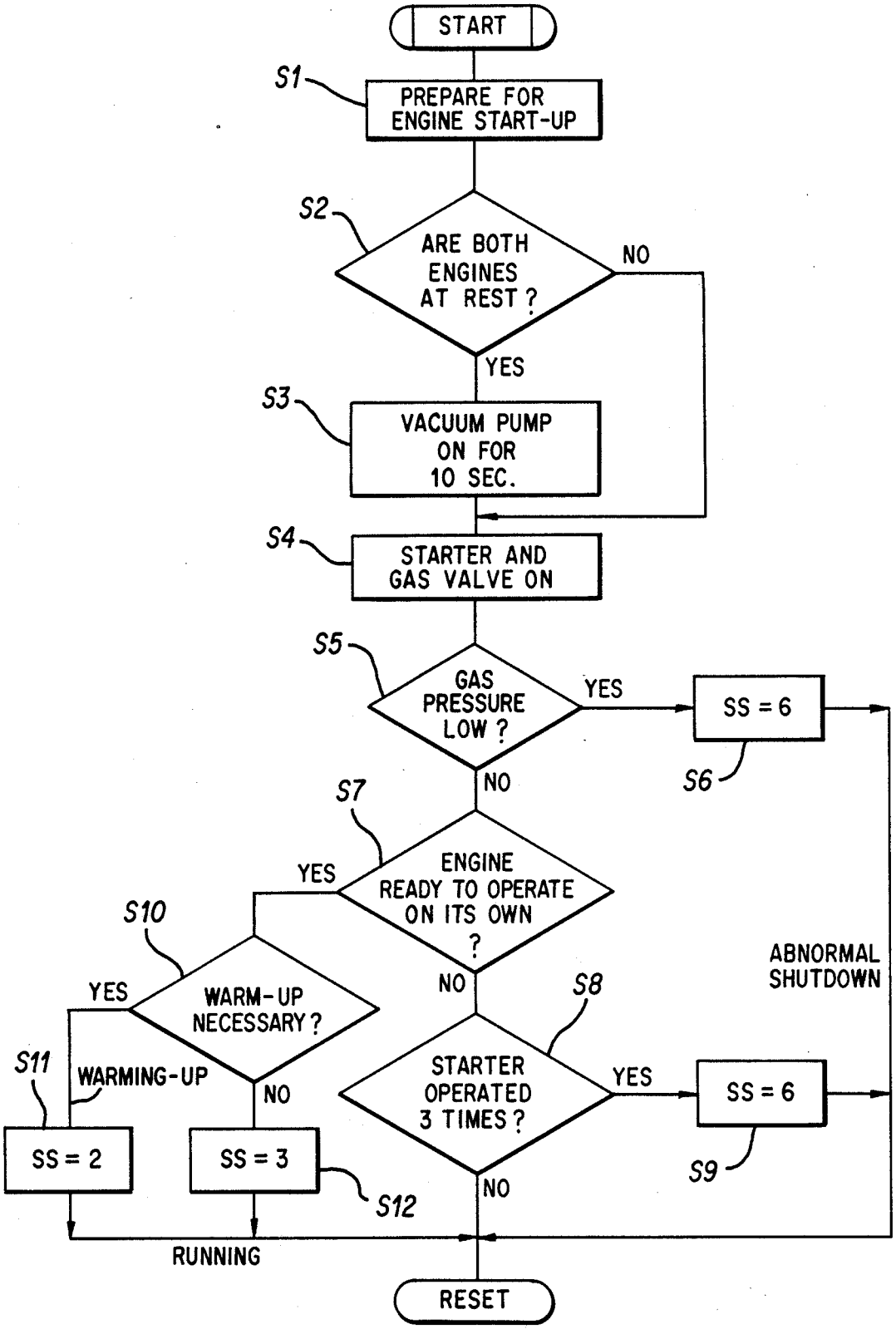
FIG. 3 is the flowchart illustrating the operations of the preferred embodiment of the invention.

FIG. 3 illustrates in flow chart form the operation of the preferred embodiment described above. In step S1, the cooling water pump, cooling water solenoid valve and engine room ventilation fan are turned on to prepare for engine start-up. In Step S2, it is determined whether No. 1 engine (1) and No. 2 engine (51) are at rest or not. If the determination in step S2 is YES, the vacuum pump (110) is turned on for 10 seconds in step S3. In step S4, the starter and gas valve are turned on. If the determination in step S2 is NO, step S3 is skipped, and step S4 is directly initiated to drive the starter and gas valve.

In step S5, a determination is made as to whether a reduction in gas line pressure due to the operation of the air conditioner may affect the gas users on the same gas service line. If the determination in step S5 is YES, the process advances to step S6, and an abnormal shutdown takes place. If the determination in step S5 is NO, the process advances to step S7 where a determination is made as to whether the engine is ready to operate on its own with its speed at 800 rpm or higher.

If the determination in step S7 is NO, the process advances to step S8 in which a determination is made as to whether the starter has been turned over three times. If the determination in step S8 is YES, the process advances to step S9 for abnormal shutdown.

If the determination in step S7 is YES, the process advances to step 10 where the time after engine start-up is measured, for example, on a timer to check whether warming-up is necessary. If the determination in step 10 is YES, the process advances to S11, and warming-up is conducted. If the determination in step S10 is NO, the process goes to step S12, and full operation is started.

During operation, the ignition coils (not shown in the figures) of No. 1 engine (1) and No. 2 engine (55) send signals regarding the speed of the engines to the controller (28). The speed controller (107) performs on-off control of the control valve (106), vent valve (105), and gain control valve (104). The speed controller (117) performs on-off control of the control valve (116), vent valve (115), and gain control valve (114).

Table 1 shows an example of the on-off status of these valves in relation to the negative pressure status os actuators (102, 112).

In FIG. 1, if the clutch ($CR_1$) for No. 1 compressor (5) and the clutch ($CR_4$) of No. 4 compressor (56) are turned on, the speed of the corresponding engines will fall, and may stall if nothing is done. If the clutches ($CR_1$) and ($CR_4$) are turned off, the corresponding engines will shown a rapid increase in their speed. To counter these situations, the speed controllers (107, 117) are used.

In FIG. 2, the vent valves (105, 115) are 3-way valves. Their common port is connected with a negative pressure line (11), and the other ports with another negative pressure line (12) and exhaust line (13). The other end of the exhaust line (13) is open to the air.

When the vent valves (105, 115) are on, the negative pressure lines (11, 12) are made to communicate with each other. When the vent valves (105, 115) are turned off, they are vented to the open air through the negative pressure line (11).

The negative pressure line (11) is provided with an orifice (103 or 113), and the pressure generated at the common port of the vent valve (105 or 115) is communicated to the actuator (102 or 112) through the negative pressure line (14).

When the gain control valve (104 or 114) is turned on, the negative pressure lines (14, 11) are made to communicate with each other.

When the control valve (106 or 116) is turned on, the negative pressure line (12) and the negative pressure generating circuit (M) are connected together. Should the engine speed change abruptly, the gain control valve, vent valve and control valve are controlled so that the negative pressure in the actuator will respond quickly to such a change as shown in Table 1. As a result, the engine throttle level is opened or closed quickly to control the engine speed.

When the load stabilizes, the gain control valve (104 or 114) is turned off to prevent the engine from being subjected to hunting.

While maintaining the engine speed, the gain control valve, vent valve and control valve are controlled so that the negative pressure in the actuator will be kept constant as shown in Table 1.

When it is necessary to increase or decrease the engine speed under normal running conditions, the gain control valve, vent valve and control valve are controlled as as to increase or decrease the negative pressure in the actuator as shown in Table 1.

In this way, No. 1 engine (1) and No. 2 engine (55) can always be controlled to run at specified speeds.

TABLE 1

| Negative pressure in actuator | Gain control valve | Vent valve | Control valve |
|---|---|---|---|
| Sudden fall | ON | OFF | OFF |
| Decrease | OFF | OFF | OFF |
| kept constant | — | ON | OFF |
| Increase | OFF | ON | ON |
| Sudden rise | ON | ON | ON |

In the preferred embodiment discussed above, a common negative pressure generating circuit is used for the control of No. 1 engine (1) and No. 2 engine (55). As a result, the number of components required is reduced, which leads to the reduction in both production cost and size of the overall system.

Unlike the conventional speed control system, the preferred embodiment of the present invention reduces the control overhead time because if at least one engine is operating in step S2 in the flow-chart in FIG. 3, step S4 is directly initiated by skipping step S3 which cannot be omitted in the conventional speed control system.

The present invention offers a multiple engine-driven air conditioner with an improved speed control system that features less components, more compactness, reduced production cost, quicker response and higher control accuracy than conventional speed control systems.

Legend:
(1): No. 1 engine
(5): No. 1 compressor
(6): No. 2 compressor
(27): Actuator
(28): Controller
(51): No. 2 engine
(55): No. 3 compressor
(56): No. 4 compressor
(77): Actuator
(101), (111): Throttle lever
(102), (112): Actuator
(103), (113): Orifice
(104), (114): Gain control valve
(105), (115): Vent valve
(106), (116): Control valve
(107), (117): Speed controller
(108): Vacuum switch
(109): Vacuum tank
(1), (10): Vacuum pump.

We claim:

1. An engine-driven air conditioner engine speed control system comprising a plurality of engines, each having a heat pump circuit including a compressor, a refrigerator circuit reversing valve, an indoor heat exchanger, expansion valves, and an outdoor heat exchanger; a negative pressure generating circuit connected in common to the intake manifolds of each engine; a plurality of negative pressure transmission circuits connected to said negative pressure generating circuit via a multi-port joint; actuators in said negative pressure transmission circuits for controlling the throttle levers of each engine; and a controller for controlling said negative pressure generating circuit and said negative pressure transmission circuits.

* * * * *